United States Patent [19]

Luck et al.

[11] Patent Number: 4,497,356

[45] Date of Patent: Feb. 5, 1985

[54] SCREENING APPARATUS

[75] Inventors: Terry C. Luck, Rayleigh; Paul R. Marsden, High Wycombe, both of England

[73] Assignee: Intercraft Designs Limited, England

[21] Appl. No.: 380,751

[22] Filed: May 21, 1982

[30] Foreign Application Priority Data

May 21, 1981 [GB] United Kingdom ..... 8115613

[51] Int. Cl.[3] ..... A47G 5/00

[52] U.S. Cl. ..... 160/135; 160/229 R; 52/36

[58] Field of Search ..... 160/135, 351, 235, 229 R, 160/231 A; 52/36

[56] References Cited

U.S. PATENT DOCUMENTS

| | | | |
|---|---|---|---|
| 3,570,579 | 3/1971 | Matsushima | 160/235 |
| 3,856,981 | 12/1974 | Boundy | 160/135 |
| 4,020,604 | 5/1977 | Legler et al. | 160/351 |
| 4,060,294 | 11/1977 | Haworth et al. | 160/135 |
| 4,232,724 | 11/1980 | Brown | 160/135 |

*Primary Examiner*—Peter M. Caun

*Attorney, Agent, or Firm*—Burns, Doane, Swecker & Mathis

[57] ABSTRACT

An upright member for supporting partitioning panels having means for retaining a panel, and means for pivotally connecting the member to and adjacent member.

8 Claims, 10 Drawing Figures

SCREENING APPARATUS

This invention relates to an upright member for supporting interior partitioning and to partitioning incorporating such members.

The partitioning is intended for internal division of areas in buildings into units where staff can work screened from one another.

According to the present invention an upright member for supporting partitioning panels is provided with means for retaining the panels, and means for pivotally connecting the member to an adjacent member.

The means for pivotally connecting the member to an adjacent member preferably permits adjacent members to be connected to one another in angular positions over an arc of 90°. The means for pivotally connecting the members together may comprise interengaging arcuate grooves and projections. In this case each upright may be provided with a groove and a joining member may be arranged with two arcuate projections each adapted to engage respectively a groove in the adjacent uprights.

In a preferred arrangement the uprights are provided with two arcuate grooves respectively for left hand or right hand connection. The joining member is conveniently symetrically shaped and can interengage with both the left or right hand groove.

In any case the uprights are preferably provided with channels for electrical wiring the channels being closed by a flap resiliently biased against an edge so as to permit wire to be led between the flap and the edge to a point of use. These rubber flaps enable wires such as for tape-recorders VDU equipment and the like to be taken through at the required height with the minimum of cable being visible and in the way.

According to a further aspect of the present invention partitioning comprises two upright members each as set forth and connected together for pivotal movement.

According to a still further aspect of the present invention partitioning comprises two upright members each as set forth, and arranged to face one another with screening extending between them to form a partitioning panel.

Preferably the panel includes a centre frame and exterior facing panels. The centre frame may be a foam filled interior and surfaced by exterior panels having hardwood rears abutting the central frame and then a mineral wool interior covered by a facing such as fabric or wood. Alternatively the centre frame may have plaster board sides with a Dufalyte infill. Here the facing panels may be fabric covered if desired. The members and/or partitioning may be arranged to accomodate task lights and in addition there may be lights fitted in the top of the panels for indirect illumination.

Figure 1:
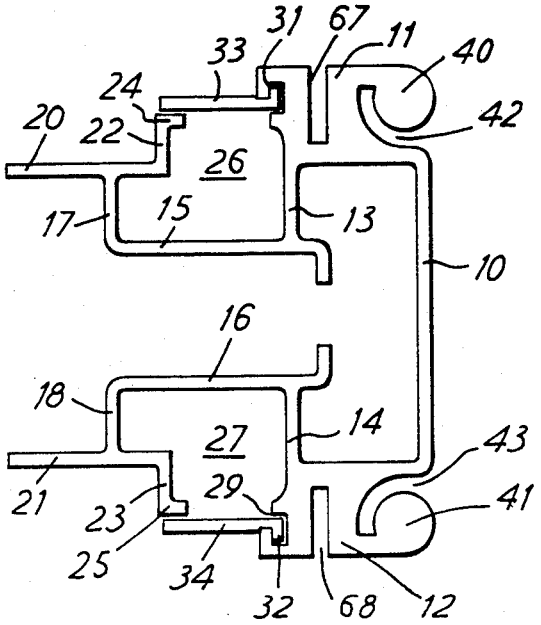
Figure 2:
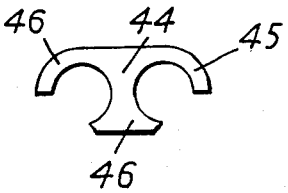
Figure 3:
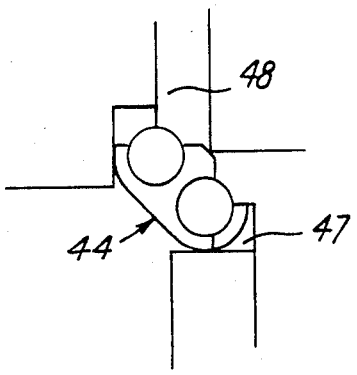
Figure 4:
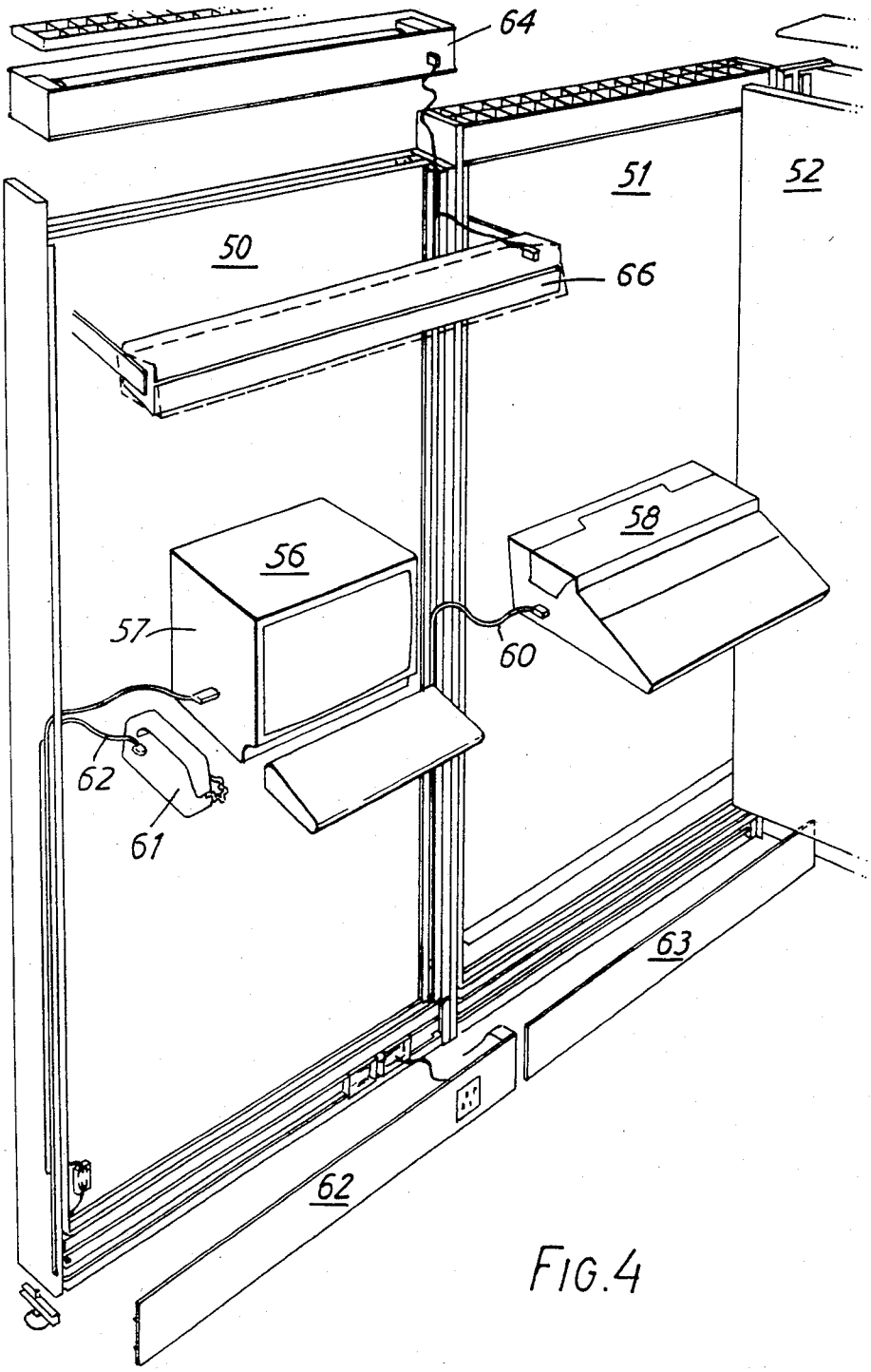
Figure 5:
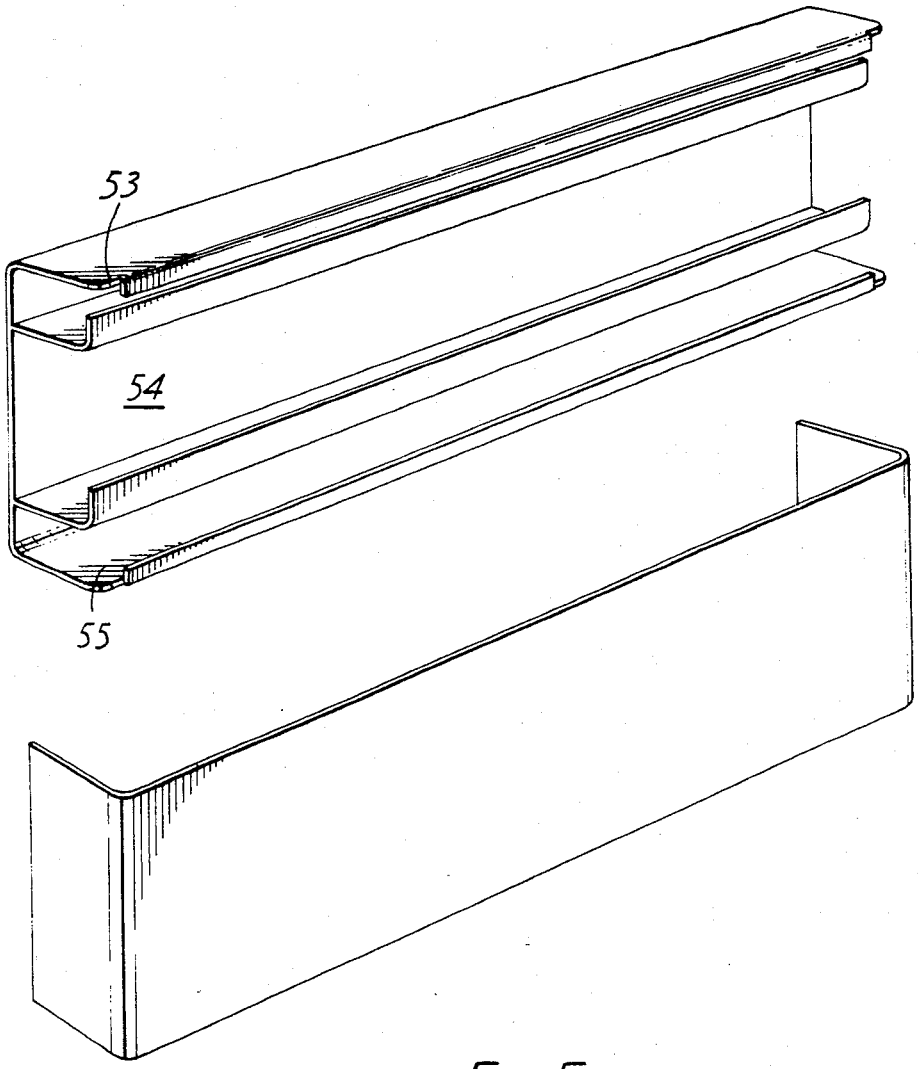
Figure 6:
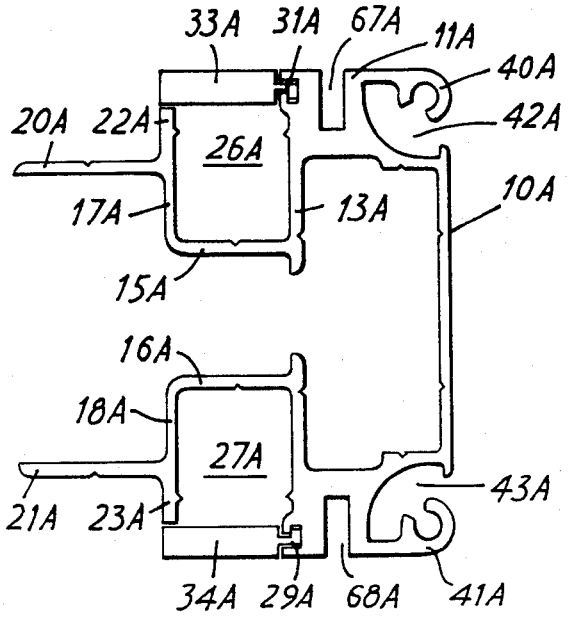
Figure 8:
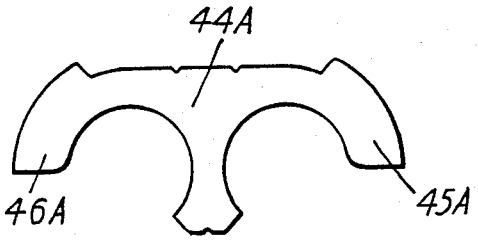
Figure 7:
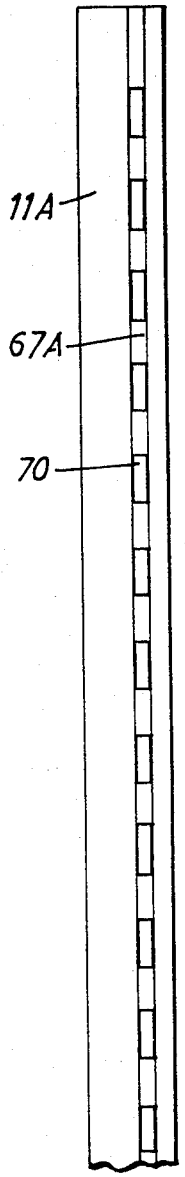
Figure 9:
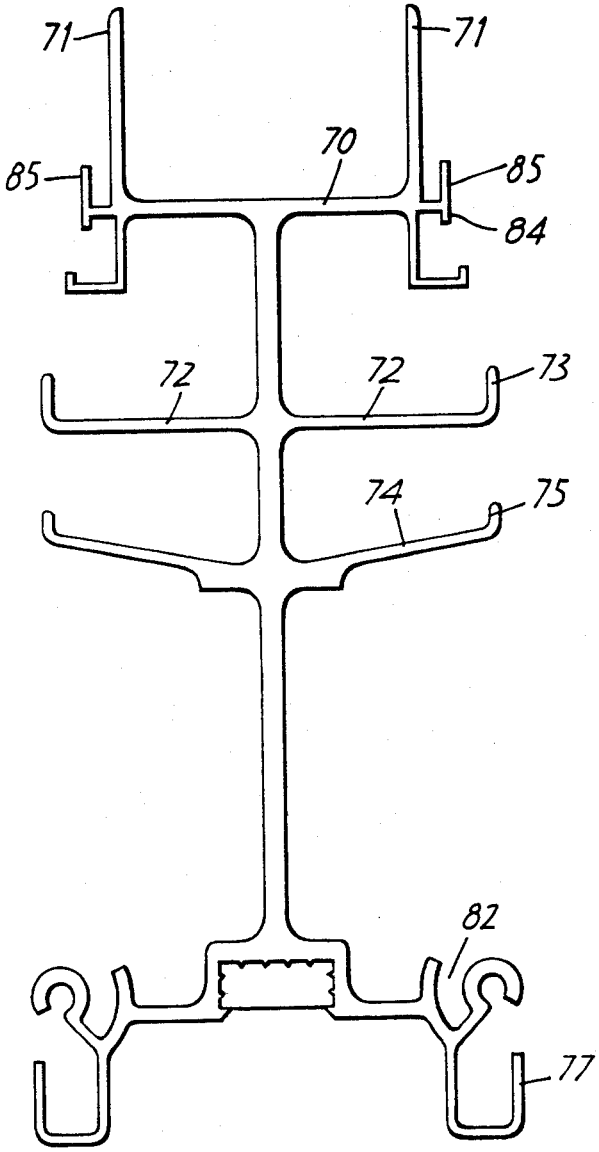
Figure 10:
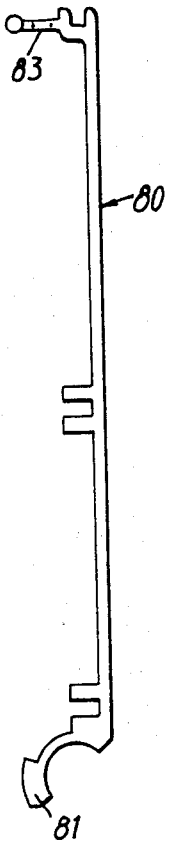

The invention may be performed in various ways and one specific embodiment and various modifications which may be made thereto will now be described by way of example with reference to the accompanying drawings in which:

FIG. 1 is a plan view of one construction of an upright member according to the present invention, FIG. 2 is a plan view of a joining member for joining the two upright members of FIG. 1 together, FIG. 3 is a view of the joining member connected to two adjacent upright members arranged at 90° to one another, FIG. 4 is a general view of two panels of a partitioning assembly constructed with uprights according to the present invention, FIG. 5 is a view in further detail of the trunking at the base of a panel of FIG. 4, FIG. 6 is a plan view of modified upright member according to the present invention, FIG. 7 is an elevation of the top right hand end of FIG. 6, FIG. 8 is a plan view of an alternative joining member for joining two upright members together as shown in FIG. 6, FIG. 9 is an elevation of an alternative form of base trunking and FIG. 10 is an elevation of a closure member for closing the base trunking of FIG. 9.

As shown in FIGS. 1 to 5 and particularly in FIG. 1 each upright comprises a rear face 10 supported between side members 11 and 12 which will be described in more detail below.

Connected to the members 11 and 12 are inwardly extending flanges 13 and 14 which are in turn respectively adjacent to one end of parallel spaced apart members 15 and 16. The members 15 and 16 have their outer ends bent at 90° to form further flanges 17 and 18 parallel to flanges 13 and 14 which in turn are connected to outer spaced apart members 20 and 21, parallel to members 15 and 16.

The members 20 and 21 have at their ends nearer to end plate 10 inwardly directed flanges 22 and 23 arranged at right-angles thereto and having further short flanges 24 and 25 arranged parallel to the flanges 15 and 16 so as to form channels 26 and 27 adapted to house electrical wiring and the like.

Opposite flanges 24 and 25 are corresponding flanges 28 and 29 extending from the members 11 and 12 and form projections at one side of grooves 31 and 32 in members 11 and 12. The grooves 31 and 32 are each adapted to retain the end of rubber flaps 33 and 34 which are resiliently biased so that their outer ends engage against the outer ends of the flanges 24 and 25. This enables electric conduits to be led up through the channels 26 and 27 and to be taken out only at the place required through the rubber flap so that the cables can remain as short as possible at the actual point of use.

In use each panel has two uprights as shown in FIG. 1 facing one another and spaced apart from one another and having screening extending between them.

The screening between the two upright members comprises a central wooden frame of rectangular shape and which is located by having a tongue which is located between the flanges 15 and 16 and is connected thereto by bolts, such as male and femaledrum bolts extending through openings in the tongues and flanges 15 and 16, the edge of the frame from which the tongue projects being located and abutting against flanges 17, 18 and 20, 21. The interior of the frame is filled with foam and is provided with a PVC cover. The external covering on each side of the partition is provided by external members which are hardboard backed and which are located on the flanges 20 and 21 on the exterior thereof, abut at their ends against flanges 22 and 23 and are filled with mineral wool and covered with an exterior decorative covering such as PVC, and are fixed to the flanges 20 and 21 by a keyhole system extending through openings (not shown) in the said flanges.

As shown in FIGS. 1 and 2 each upright is provided with end members 11 and 12. Each of these supports an arcuate projection the outer radii of which are level with the rear face 10. Projections, numbered 40 and 41, form with the members 11 and 12 arcuate grooves 42 and 43. FIG. 2 shows a joining member 44 which is adapted to slide in the grooves 42 and 43 with its arms 45 and 46, the arm 45 being adapted to be pivotally slidable within the groove 42 and the arm 46 pivotally slidable within the groove 43. One such joining member is required between two panels where they are connected at an angle to one another. Such an arrangement is shown in FIG. 3 where an upright 47 is joined to a second upright 48. As the panel is of considerable width i.e. approximately 80 mm it is necessary to provide two grooves 42 and 43 respectively to provide left or right hand hinging. The hinge formed by the joining member 44 and the grooves and arcuate members 41 permits movement of 90° of the panels with respect to one another, i.e. they can be parallel or arranged up to 90° to one another. In the case where the panels are arranged parallel to one another two joining members can be inserted one on each side so as to maintain the panels rigidly in line. As the member 44 is symmetrical it can be used either in the grooves 42 or in the grooves 43.

FIG. 4 shows schematically partitioning according to the present invention with two panels labelled 50 and 51 arranged in line with one another and a panel 52 arranged at right angles thereto. Each of the panels is formed as set forth above and has at its base trunking one side of which is shown more clearly in FIG. 5. The trunking is divided into three channels 53, 54 and 55. The channel 53 is for telephone wires, the channel 54 for electrical cables and the channel 55 for VDU cables. The wires are shown diagrammatically in FIG. 4 and for example a VDU unit 56 is shown supplied by a wire 57 emanating from trunking 55, a typewriter 58 supplied by a wire 60 emanating from trunking 54 and a telephone 61 supplied by a wire 62 emanating from trunking 53. Power points as can be seen are also supplied, the base trunking being closable by covers 62 and 63, suitable sockets also being provided as required. In each case the wires are led up the uprights and extend through the rubber flaps so as to be as short as possible at the point of use.

The tops of the panels are slightly recessed so as to receive lamps 64 and 65 to provide indirect lighting. Moreover, a task light 56 can also be provided which is adjustable in slotted angle which are shown in FIG. 1 at 67 and 68.

The indirect illumination can be replaced by top covers if preferred.

In the construction shown in FIG. 6 the parts are generally similar to those shown in FIG. 1 and the principle is the same. However, some of the dimensions are slightly different although these serve the same functions, and they have where appropriate been given the same reference numerals suffixed 'A'. It will be seen that in particular the projections 40 and 41 have been somewhat modified as shown at 40A and 41A whilst the grooves have been made somewhat larger as these are shown as 42A and 43A. The joining member shown in FIG. 8 is also correspondingly modified and in this case joining member 44A is adapted to slide in the grooves 42A and 43A with its arm 45A and 46A, the arm 45A being adapted to be pivotally slidable within the groove 42A and the arm 46A pivotally slidable within the groove 43A. The principle here is the same as described previously with one such joining member being required to two panels where they are connected at an angle to one another.

FIG. 7 shows a part elevation of the member shown in FIG. 6 sufficient to show the groove which has been numbered 67A. This is provided with a series of slots 70 and these serve to receive hooks from items to be attached in the grooves 67A. The same arrangement may be used in FIG. 1. As explained with reference to FIG. 1 these can recive task lights, and also cupboards and the like which serve to support them and rigidly secure them to the partitioning.

A modified trunking and base arrangement for the panelling is shown in FIG. 9. In this arrangement the base of the panel is received within a channel 70 having side supports 71 on either side thereof. Below the member 71 supporting the channel and spaced downwardly therefrom are lateral projections 72 having upright ends 73, these serving to enclose an area in which VDU auxiliary cables can be placed. Below this is a second lateral but in this case upwardly projecting flange 74 having a vertical end 75, these forming areas in which telephones and the like can be housed. Below this and spaced some way therefrom is a base member indicated generally at 76 defining an area above it to receive power cables. Attached to the base member 76 on either side are further U-shaped channels 77 to house external cables should these be required. FIG. 10 shows a closure member for closing the sides of the base in FIG. 9. This comprises a plate the length of which can be varied and one or more plates may extend along the base, the plate indicated generally at 80 and having at its base an arcuate shaped member 81 which is adapted to be received in an arcuate groove 82 in the base member 76. At its upper end plate 80 has a resiliently retainable projection 83. In operation the operator puts the arcuate shaped member 81 on the plate into the arcuate shaped groove 82 in the base and then pivots it from a generally horizontal position into a vertical position in which position member 83 will be a snap-fit under a projection 84 at the upper end of the base member. The arrangement is such that it is a snap fit and can be removed readily when required but the resilience is such as to make it not easily removed so that it will not be dislodged accidentally.

It can be seen from FIG. 9 that at the outer sides of the members 71 there are provided spaced upwardly directed flanges 85. In this construction these serve to retain the lower sides of panels forming external covering. In this construction these are not attached to the flanges 20, 21 by a keyhole system as in the previous construction but are instead clipped at the top of the partitioning by U-shaped clips which fit over the exterior of the coverings and hold them in position against the core member. A keyhole system can also be provided either in addition to or alternatively if required.

The frame may be modified and may be two layers of plaster board with a Dufalyte infill.

With the partitioning systems according to the present invention it is possible to arrange panels as required with various fitments and at an angle to one another without the necessity of bolts or other joining members, the angle being selected as desired.

We claim:

1. A partitioning wall, including:

a first panel;

a second panel;

connecting means for releasably and adjustably joining the first panel to the second panel along an upright edge of each of the first and second panels;

first and second upright members, each having a left side portion, a right side portion and a rear face portion, the left side portion and the rear face portion together defining a left corner and the right side portion and the rear face portion together defining a right corner with said left and right side portions being arranged on the same side of the rear face portion extending generally perpendicularly from said rear face portion, said first upright member being provided along one end of the first panel and said second upright member being provided along one end of the second panel;

a first right projection provided at the right corner and extending along the first upright member, said first right projection together with said right corner defining a right arcuate groove having generally parallel sides, said right arcuate groove being provided between the first right projection and the rear face portion;

a first left projection provided at the left corner and extending along the first upright member, said first left projection together with said left corner defining a left arcuate groove having generally parallel sides, said left arcuate groove being provided between the first left projection and the rear face portion;

said connecting means including a joining member having first and second arcuate arms so as to be slidably received within said arcuate grooves of the first and second upright members, said first and second arcuate arms being defined by generally parallel side walls; and, resilient flaps resiliently biased in said first and second upright members along an outwardly facing side of said left and right side portions.

2. A partitioning wall as defined in claim 1, wherein a first end of said resilient flaps is secured in grooves provided in said first and second upright members and a second end of said resilient flaps overlaps a flange portion of said first and second upright members so as to define a substantially enclosed side channel section in said first and second upright members.

3. A partitioning wall as defined in claim 2, wherein the arcuate members define an outer radius portion of said first right projection and said first left projection, the rear face portion and the outer radius portion being substantially parallel to one another and of substantially equal length so as to define a vertical plane along an outermost extent of said substantially equal length.

4. A partitioning wall as defined in claim 1, wherein said first and second arcuate arms and said arcuate grooves interfit and define hinge means for permitting relative rotation of the first and second panels.

5. A partitioning wall as defined in claim 1, wherein each of the panels is provided with a base section comprising a plurality of separate channels extending along the panels length.

6. A partitioning wall as defined in claim 5, wherein said plurality of separate channels open into said side channel.

7. A partitioning wall as defined in claim 6, wherein said plurality of separate channels is accessible through a removable cover plate.

8. A partitioning wall as defined in claim 7, wherein said removable cover plate is provided with electrical receptacles.

* * * * *